US008720889B2

(12) United States Patent
Samoto et al.

(10) Patent No.: US 8,720,889 B2
(45) Date of Patent: May 13, 2014

(54) CONVEYOR DEVICE

(71) Applicants: Kenji Samoto, Nagoya (JP); Noriyuki Kawamata, Nagoya (JP)

(72) Inventors: Kenji Samoto, Nagoya (JP); Noriyuki Kawamata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/851,827

(22) Filed: Mar. 27, 2013

(65) Prior Publication Data

US 2013/0256985 A1 Oct. 3, 2013

(30) Foreign Application Priority Data

Mar. 27, 2012 (JP) ..... 2012-072600

(51) Int. Cl.
*B65H 5/12* (2006.01)

(52) U.S. Cl.
USPC ..... 271/266

(58) Field of Classification Search
USPC ..... 271/266, 270
See application file for complete search history.

(56) References Cited

U.S. PATENT DOCUMENTS

| | | | |
|---|---|---|---|
| 5,755,435 | A | 5/1998 | Fujiwara |
| 6,485,011 | B1 | 11/2002 | Yen et al. |
| 6,811,151 | B2 | 11/2004 | Wei-Feng et al. |
| 7,172,190 | B2 | 2/2007 | Park |
| 7,562,870 | B2 | 7/2009 | Terada |
| 8,152,161 | B2 | 4/2012 | Samoto et al. |
| 2004/0032074 | A1 | 2/2004 | Park |

FOREIGN PATENT DOCUMENTS

| | | | |
|---|---|---|---|
| JP | H10-329974 | A | 12/1998 |
| JP | 2007-217179 | A | 8/2007 |

*Primary Examiner* — Michael McCullough
(74) *Attorney, Agent, or Firm* — Baker Botts L.L.P.

(57) ABSTRACT

A conveyor device includes: a first conveyor having a first roller; a second conveyor having a second roller and disposed downstream of the first conveyor; and a storage storing first information and second information in which a velocity or a deceleration of the first and second rollers is less in the second information than in the first information. A controller executes: a first rotation processing in which, when a state in which a sheet is nipped by the first conveyor is kept during a next conveyance in intermittent conveyance, a first roller and a second roller are rotated according to the first information in the next conveyance; and a second rotation processing in which, when the state is not kept in the next conveyance, the first drive roller and the second drive roller are rotated according to the second information in the next conveyance.

13 Claims, 11 Drawing Sheets

CONVEYOR DEVICE

CROSS REFERENCE TO RELATED APPLICATION

The present application claims priority from Japanese Patent Application No. 2012-072600, which was filed on Mar. 27, 2012, the disclosure of which is herein incorporated by reference in its entirety.

BACKGROUND OF THE INVENTION

1. Field of the Invention

The present invention relates to a conveyor device configured to convey a sheet.

2. Description of the Related Art

There is known a conveyor device configured to convey a sheet along a conveyance path formed in the conveyor device. Examples of this conveyor device include an image recording apparatus such as a printer and a multi-function peripheral (MFP). The conveyor device includes roller pairs arranged at a plurality of positions on the conveyance path.

One example of such a conveyor device is a conveyor device configured to transmit, to a roller, only one of driving powers respectively produced by forward and reverse rotations of a drive source. In this design, when one of the forward and reverse rotations is made by the drive source, the roller is rotated to convey the sheet, but when the other of the forward and reverse rotations is made by the drive source, the roller is not rotated and does not convey the sheet. This conveyor device includes a well-known one-way clutch that is disposed on a power transmitter for transmitting the driving power from the drive source to the roller.

SUMMARY OF THE INVENTION

However, in a case where the one-way clutch is disposed on the power transmitter for transmitting the driving power from the drive source to the roller as described above, even when the drive source for the roller is suddenly stopped, the one-way clutch is not suddenly stopped immediately. This one-way clutch is stopped when rotated by a specific amount after the sudden stop of the drive source. Thus, this roller is rotated due to inertia by an amount related to the rotation of the one-way clutch by the specific amount.

That is, the sheet is conveyed by the inertia of the roller, resulting in positional error of the sheet in the conveyance path.

This invention has been developed to provide a technique capable of reducing positional error of a sheet due to inertia of a roller when the roller conveys the sheet.

The present invention provides a conveyor device, comprising: a drive source configured to produce: a first rotational driving power by a forward rotation of the drive source; and a second rotational driving power by a reverse rotation of the drive source; a first conveyor comprising a first drive roller and a first driven roller, the first conveyor being configured to convey the sheet in the conveying direction while nipping the sheet; a second conveyor disposed downstream of the first conveyor in a conveying direction, the second conveyor comprising a second drive roller and a second driven roller; a first power transmitter configured to transmit the first rotational driving power and the second rotational driving power to the first drive roller, the first power transmitter being configured to have the first conveyor convey the sheet in the conveying direction while nipping the sheet when the first rotational power is transmitted to the first drive roller, the first power transmitter being configured to have the first conveyor convey the sheet in a direction opposite the conveying direction when the second rotational power is transmitted to the first drive roller; a second power transmitter configured to transmit the first rotational driving power to the second drive roller and not to transmit the second rotational driving power to the second drive roller, the second power transmitter being configured to have the second conveyor convey the sheet in the conveying direction while nipping the sheet when the first rotational power is transmitted to the second drive roller; a controller configured to control the drive source to perform intermittent conveyance in which a conveyance of the sheet by transmission of the first rotational driving power to the first drive roller and the second drive roller and a stop of the sheet conveyed are alternately repeated a plurality of times; and a storage configured to store first information and second information each representing velocity information of the first drive roller and the second drive roller from a start of rotation thereof to a stop of the rotation thereof in one conveyance of the sheet in the intermittent conveyance, and wherein at least one of a velocity and a deceleration, in the velocity information, of the first drive roller and the second drive roller from a constant-velocity state after an increase in velocity from the start of the rotation, to the stop of the rotation is less in the second information than in the first information, wherein the controller is configured to execute: a first rotation processing in which, when a state in which the sheet is nipped by the first conveyor is kept during a next conveyance of the sheet in the intermittent conveyance, the first drive roller and the second drive roller are rotated according to the first information in the next conveyance of the sheet; and a second rotation processing in which, when the state in which the sheet is nipped by the first conveyor is not kept in the next conveyance of the sheet, the first drive roller and the second drive roller are rotated according to the second information in the next conveyance of the sheet.

The present invention also provides a conveyor device, comprising: a drive source configured to produce: a first rotational driving power by a forward rotation of the drive source; and a second rotational driving power by a reverse rotation of the drive source; a first conveyor comprising a first drive roller and a first driven roller; a second conveyor disposed downstream of the first conveyor in a conveying direction, the second conveyor comprising a second drive roller and a second driven roller; a first power transmitter configured to transmit the first rotational driving power and the second rotational driving power to the first drive roller, the first power transmitter being configured to have the first conveyor convey the sheet in the conveying direction while nipping the sheet when the first rotational power is transmitted to the first drive roller, the first power transmitter being configured to have the first conveyor convey the sheet in a direction opposite the conveying direction when the second rotational power is transmitted to the first drive roller; a second power transmitter configured to transmit the first rotational driving power to the second drive roller and not to transmit the second rotational driving power to the second drive roller, the second power transmitter being configured to have the second conveyor convey the sheet in the conveying direction while nipping the sheet when the first rotational power is transmitted to the second drive roller; a controller configured to control the drive source to perform intermittent conveyance in which a conveyance of the sheet by transmission of the first rotational driving power to the first drive roller and the second drive roller and a stop of the sheet conveyed are alternately repeated a plurality of times; and a storage configured to store first information and second information respectively representing a first length of time and a second length of time, wherein each of the first length of time and the second length of time is a length of time from a start of rotation of the first drive roller and the second drive roller to a stop of the rotation thereof in conveyance of the sheet, and wherein the second length of time is greater in length than the first length of time, wherein the controller is configured to execute: a first rotation processing in which, when a state in which the sheet is nipped by the first conveyor is kept during a next conveyance of the sheet in the intermittent conveyance, the first drive roller and the second drive roller are rotated according to the first information in the next conveyance of the sheet; and a second rotation processing in which, when the state in which the sheet is nipped by the first conveyor is not kept in the next conveyance of the sheet, the first drive roller and the second drive roller are rotated according to the second information in the next conveyance of the sheet.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Hereinafter, there will be described one embodiment of the present invention by reference to the drawings. It is to be understood that the following embodiment is described only by way of example, and the invention may be otherwise embodied with various modifications without departing from the scope and spirit of the invention. In the following explanation, the term "direction" means a one-way direction which is directed from one point toward another point, and the term "directions" means opposite directions. That is, the term "directions" includes a direction directed from one point toward another point and a direction directed from said another point toward the one point. Also, in the following explanation, up and down directions 7 are defined as up and down directions of a multi-function peripheral (MFP) 10 illustrated in FIG. 1, i.e., the MFP 10 being in a normal state. Also, front and rear directions 8 are defined by regarding a side of the MFP 10 on which an opening 13 is formed as a front side, and right and left directions 9 are defined in a state in which the MFP 10 is seen from the front side.

<Overall Structure of MFP 10>

Figure 1:
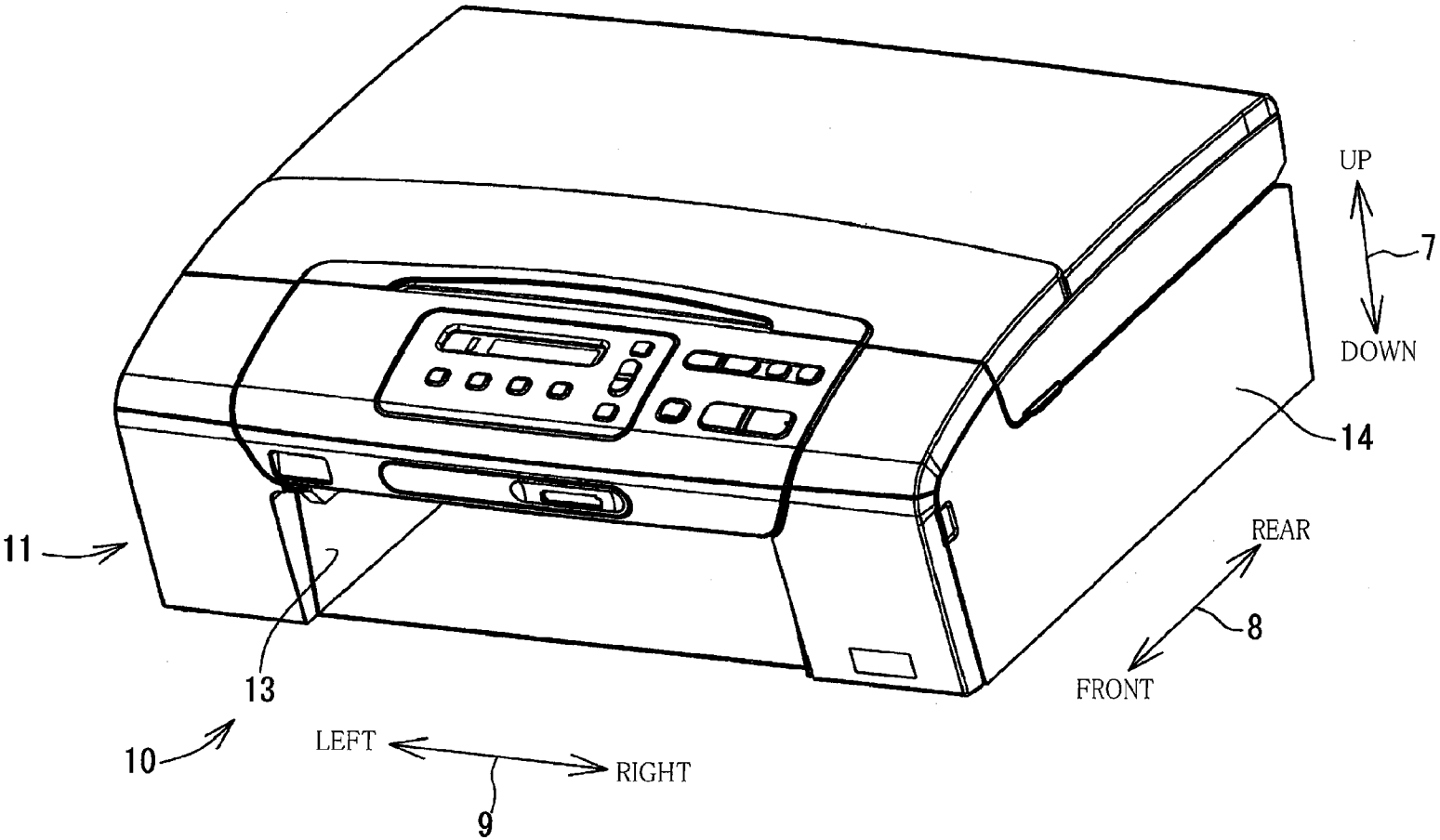
FIG. 1 is perspective view illustrating of an MFP 10.

As illustrated in FIG. 1, the MFP 10 includes a printing section 11 (as one example of a conveyor device) at its lower portion. The MR 10 has various functions such as a facsimile function and a printing function. The printing section 11 has the opening 13 in its front face. The MFP 10 includes a sheet-feed tray 20 and a sheet-output tray 21 (see FIG. 2) on which a recording sheet 12 can be placed. These trays 20, 21 can be inserted or removed through the opening 13 in the front and rear directions 8.

Figure 2:
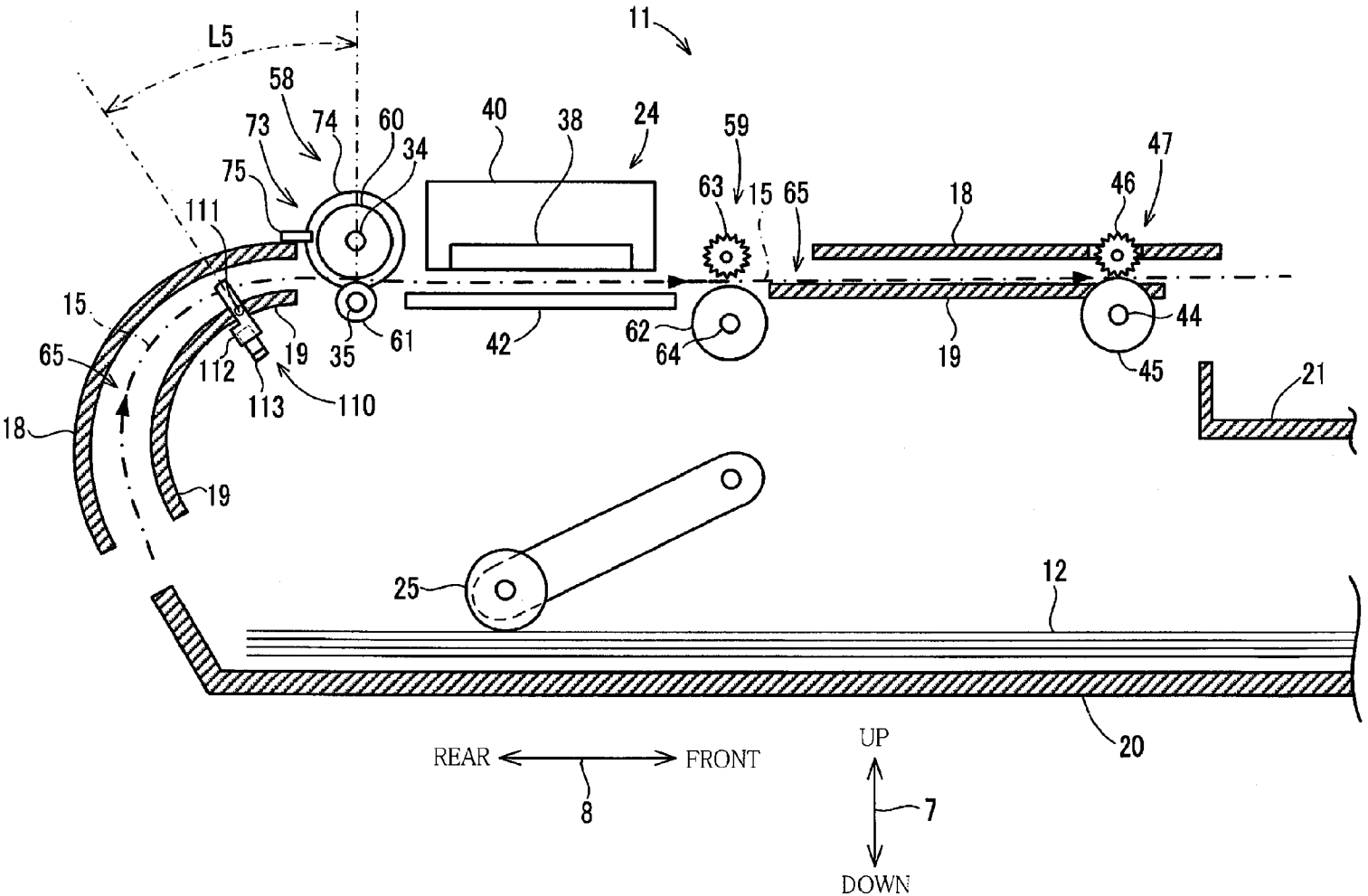
FIG. 2 is an elevational view in vertical cross section schematically illustrating an internal structure of a printing section 11.

As illustrated in FIG. 2, sheet-feed rollers 25 (as one example of a sheet feeder) are provided on an upper side of the sheet-feed tray 20. In the present embodiment, the sheet-feed rollers 25 are rotated by a power transmitted from a sheet-feed motor 70 (see FIG. 5). As a result, the recording sheet 12 placed on the sheet-feed tray 20 is supplied into a conveyance path 65. It is noted that the sheet-feed rollers 25 may be driven by a conveyor motor 71 which will be described below.

The conveyance path 65 extends from a rear end portion of the sheet-feed tray 20. The conveyance path 65 includes a curved portion and a straight portion. The conveyance path 65 is defined by an outer guide member 18 and an inner guide member 19 which are opposed to each other at a predetermined distance therebetween. The recording sheet 12 placed on the sheet-feed tray 20 is conveyed through the curved portion from its lower side toward upper side so as to make a U-turn. The recording sheet 12 is then conveyed to a recording portion 24 through the straight portion. The recording portion 24 performs image recording on the recording sheet 12. After the image recording, the recording sheet 12 is conveyed through the straight portion and discharged onto the sheet-output tray 21. That is, the recording sheet 12 is conveyed in a first direction 15 (as one example of a conveying direction) indicated by one-dot chain-line arrow in FIG. 2.

<Roller Pairs 58, 59, 47>

As illustrated in FIG. 2, a first roller pair 58 (as one example of a first conveyor) is provided on the conveyance path 65 between the sheet-feed rollers 25 and the recording portion 24. This first roller pair 58 is comprised of a first conveyor roller 60 (as one example of a first drive roller) and pinch rollers 61 (as one example of a first driven roller) which are held in contact with each other. Also, a second roller pair 59 (as one example of a second conveyor) is disposed on the conveyance path 65 at a position located downstream of the recording portion 24 in the first direction 15. The second roller pair 59 is comprised of second conveyor rollers 62 (as one example of a second drive roller) and a spur 63 (as one example of a second driven roller) which are held in contact with each other. Also, a third roller pair 47 is disposed on the conveyance path 65 at a position located downstream of the second conveyor rollers 62 in the first direction 15. The third roller pair 47 is comprised of third conveyor rollers 45 and a spur 46. It is noted that the MFP 10 may not include the third roller pair 47.

Each of the conveyor rollers 60, 62, 45 is rotated by a driving power (force) transmitted from the conveyor motor 71 (see FIG. 5) via a first power transmitter 48 which will be described below. The second conveyor rollers 62 are rotated by the driving power transmitted from the first conveyor roller 60 via a second power transmitter 49 which will be described below. The third conveyor rollers 45 are rotated by the driving power transmitted from the second conveyor rollers 62 via a third power transmitter 50 which will be described below. The conveyor motor 71 is rotatable in its forward direction and reverse direction. When a driving power produced by the forward rotation of the conveyor motor 71 is transmitted to each of the conveyor rollers 60, 62, 45, each of these conveyor rollers 60, 62, 45 is rotated in a first rotational direction. Here, the first rotational direction is a rotational direction for conveying the recording sheet 12 in the first direction 15. When a driving power produced by the reverse rotation of the conveyor motor 71 is transmitted to each of the conveyor rollers 60, 62, 45, each of these conveyor rollers 60, 62, 45 is rotated in a second rotational direction. Here, the second rotational direction is reverse to the first rotational direction. The pinch rollers 61 and the spurs 63, 46 are rotated by the rotations of the respective conveyor rollers 60, 62, 45. In the constructions described above, each of the roller pairs 58, 59, 47 nips and conveys the recording sheet 12.

It is noted that the first conveyor roller 60 is disposed so as to contact one face of the recording sheet 12, and both of the second conveyor rollers 62 and the third conveyor rollers 45 are disposed so as to contact another face of the recording sheet 12. In FIG. 2, when the first conveyor roller 60 is rotated in a counterclockwise direction, the second conveyor rollers 62 and the third conveyor rollers 45 are rotated in a clockwise direction, so that the conveyor rollers 60, 62, 45 convey the recording sheet 12 in the first direction 15. In this case, a direction of each of the rotations of the respective conveyor rollers 60, 62, 45 is the first rotational direction. In the following description, the rotation of each of the conveyor rollers 60, 62, 45 in the first rotational direction may be called a rotation of a corresponding one of the conveyor rollers 60, 62, 45 in a forward direction, and the rotation of each of the conveyor rollers 60, 62, 45 in the second rotational direction may be called a rotation of the corresponding one of the conveyor rollers 60, 62, 45 in a reverse direction.

<Recording Portion 24>

As illustrated in FIG. 2, the recording portion 24 is provided on an upper side of the conveyance path 65. A platen 42 is provided under the recording portion 24 so as to be opposite the recording portion 24. The platen 42 is a plate-like member for supporting the recording sheet 12 conveyed in the conveyance path 65. The recording portion 24 employs a well-known ink-jet ejection method to record an image on the recording sheet 12 supported on the platen 42. The recording portion 24 includes: a recording head 38 having a multiplicity of nozzles for ejecting ink droplets onto the recording sheet 12; and a carriage 40 for holding the recording head 38 thereon. The carriage 40 is supported by, e.g., a frame of the printing section 11 so as to be reciprocable in the right and left directions 9. The carriage 40 is coupled to a carriage drive motor 103 (see FIG. 5) by a well-known belt mechanism. Upon receipt of a driving power transmitted from the carriage drive motor 103, the carriage 40 is reciprocated in the right and left directions 9. It is noted that a method for recording an image on the recording sheet 12 by the recording portion 24 is not limited to the ink-jet method and may be an electronic photographic method, for example.

<Sensor 110>

As illustrated in FIG. 2, a sensor 110 is provided in the conveyance path 65 at a position located upstream of the first conveyor roller 60 in the first direction 15. The sensor 110 includes: a shaft 111; a detector 112 pivotable about the shaft 111; and an optical sensor 113 that includes a light emitting element and a light receiving element for receiving light emitted from the light emitting element.

One end of the detector 112 projects into the conveyance path 65. When an external force is not applied to the one end of the detector 112, the other end of the detector 112 is located in a light path extending from the light emitting element to the light receiving element to interrupt the light from traveling through the light path. In this state, the optical sensor 113 outputs a low-level signal to a controller 130 which will be described below. When the one end of the detector 112 is pressed by a leading edge of the recording sheet 12 to rotate the detector 112, the other end of the detector 112 is moved out of the light path, causing the light to pass through the light path. In this state, the optical sensor 113 outputs a high-level signal to the controller 130. On the basis of the signal received from the optical sensor 113, the controller 130 senses the leading edge and a trailing edge of the recording sheet 12 in the first direction 15. The sensor 110 and the controller 130 are one example of a sheet sensor.

<Rotary Encoder 73>

As illustrated in FIG. 2, the first conveyor roller 60 is provided with a rotary encoder 73 that detects rotational amounts of the respective conveyor rollers 60, 62, 45. The rotary encoder 73 includes: an optical sensor 75; and an encoder disc 74 provided on a shaft 35 of the first conveyor roller 60 so as to be rotated together with the first conveyor roller 60. The encoder disc 74 includes: light transmitting portions allowing light to pass therethrough; and light intercepting portions inhibiting the light from passing therethrough. These light transmitting portions and light intercepting portions are alternately arranged at regular pitches in a circumferential direction so as to form a predetermined pattern. The rotary encoder 73 produces a pulse signal each time when the light transmitting portion and the light intercepting portion are sensed by the optical sensor 75 during the rotation of the encoder disc 74. The produced pulse signals are transmitted to the controller 130. The controller 130 calculates a rotational amount of the first conveyor roller 60 on the basis of the pulse signals. The rotary encoder 73 and the controller 130 are one example of a first-drive-roller rotational amount detector.

<Power Transmitters 48, 49, 50>

Figure 3:
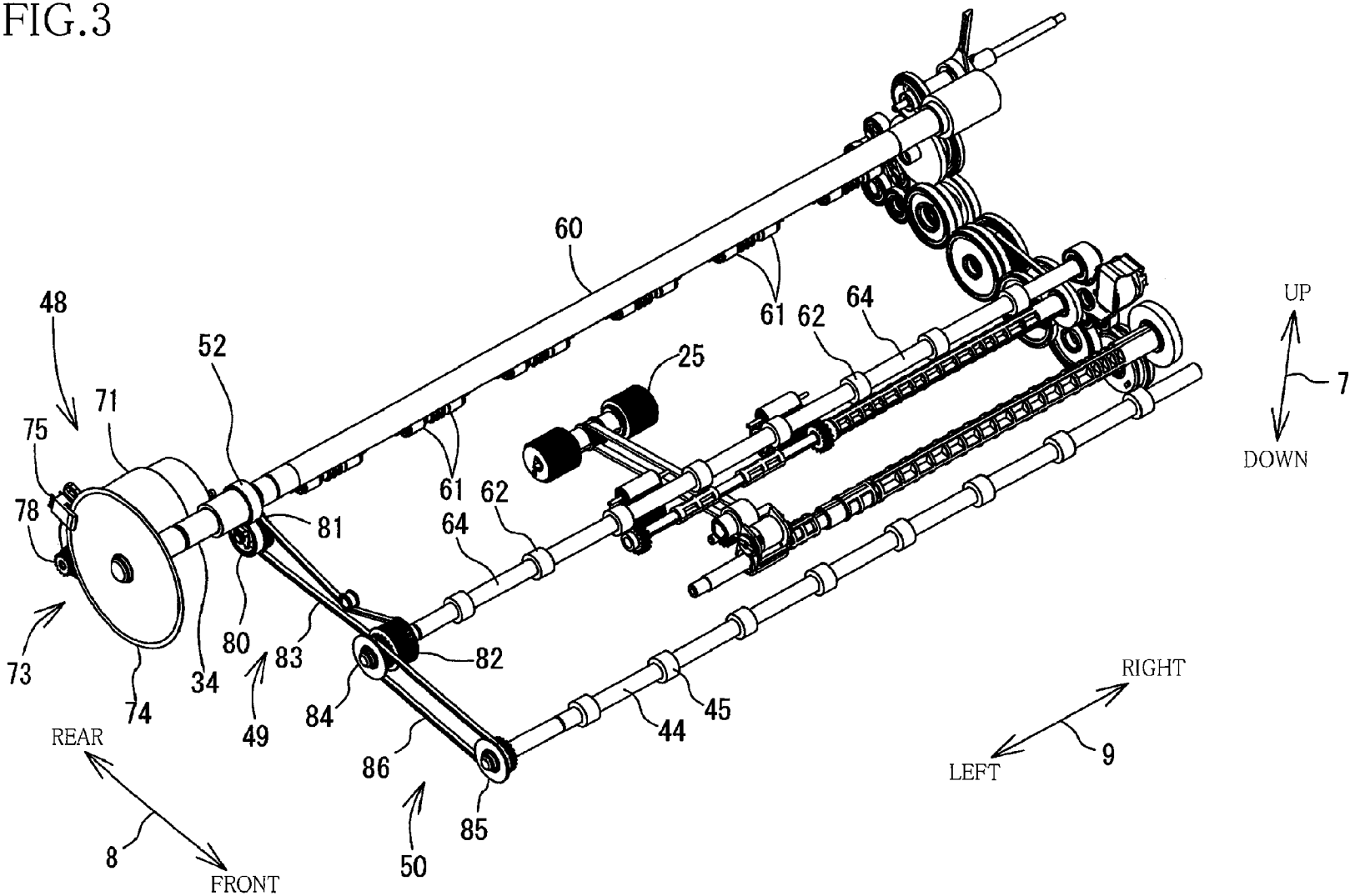
FIG. 3 is a perspective view illustrating power transmitters 48-50 and conveyor rollers 60, 62, 45.
Figure 4:
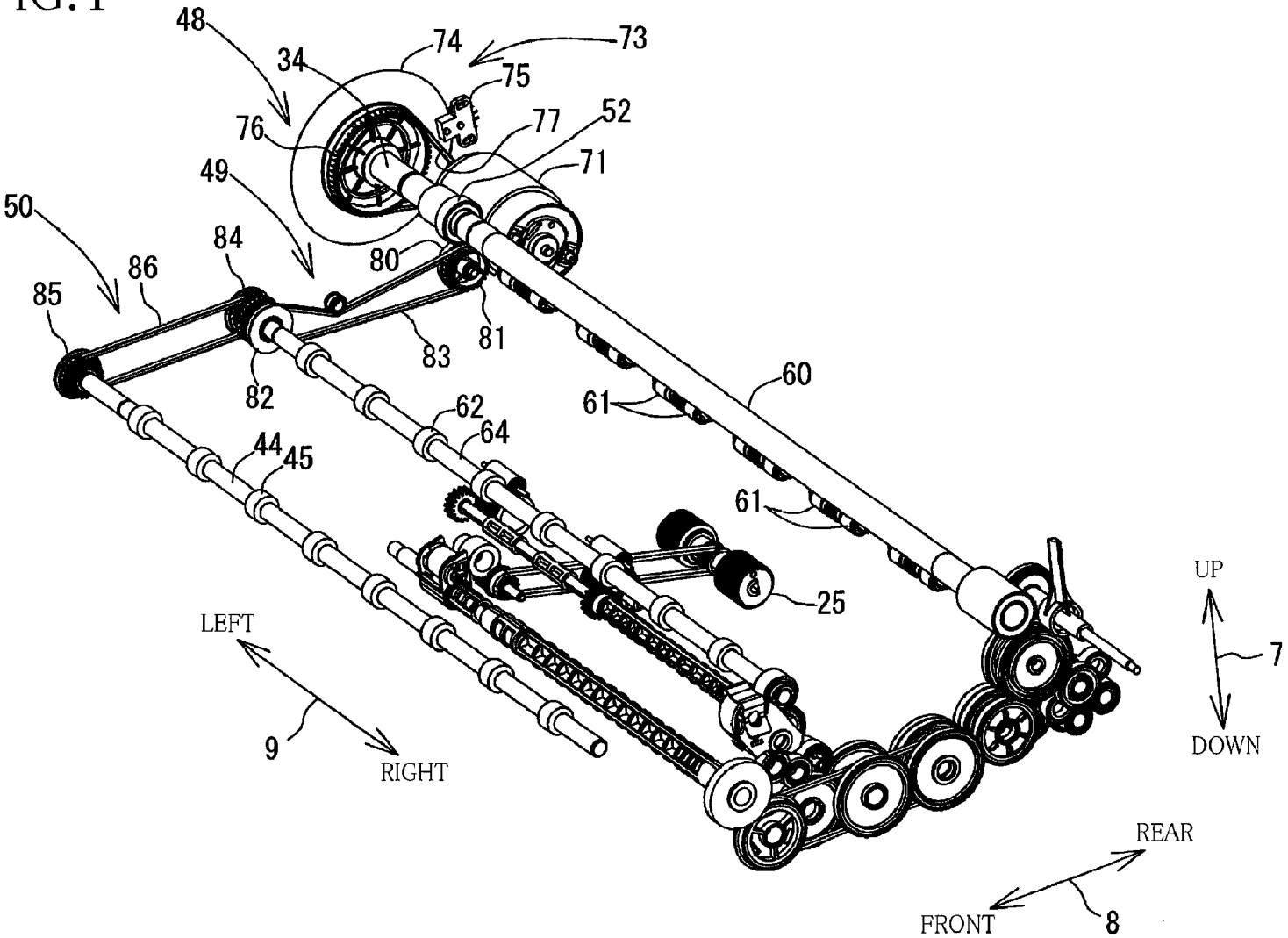
FIG. 4 is another perspective view illustrating the power transmitters 48-50 and the conveyor rollers 60, 62, 45.

As illustrated in FIGS. 3 and 4, the first power transmitter 48 includes a first pulley 76, a motor pulley 78, and a first belt 77. On a left side of the conveyance path 65, the first pulley 76 is mounted on a shaft 34 of the first conveyor roller 60. The motor pulley 78 is mounted on a shaft, not shown, of the conveyor motor 71. The endless first belt 77 is looped over the first pulley 76 and the motor pulley 78 so as to be tensioned therebetween. As a result, the rotational driving power produced by the conveyor motor 71 is transmitted to the first conveyor roller 60. Specifically, when the conveyor motor 71 is rotated in the forward direction, the first conveyor roller 60 is rotated in the first rotational direction. When the conveyor motor 71 is rotated in the reverse direction, the first conveyor roller 60 is rotated in the second rotational direction.

The second power transmitter 49 includes a first gear 52, a second gear 80, a second pulley 81, a third pulley 82, and a second belt 83. The first gear 52 is provided on the shaft 34 of the first conveyor roller 60 on a left side of the conveyance path 65. The second gear 80 is mounted on the shaft 35 (see FIG. 2) of the pinch rollers 61 and meshed with the first gear 52. The second pulley 81 is mounted on the shaft 35 on a right side of the second gear 80. The third pulley 82 is mounted on a shaft 64 of the second conveyor rollers 62. The endless second belt 83 is looped over the second pulley 81 and the third pulley 82 so as to be tensioned therebetween. As a result, the rotational driving power transmitted to the first conveyor roller 60 is transmitted to the second conveyor rollers 62.

The third pulley 82 is mounted on the shaft 64 via a well-known one-way clutch. As a result, in the present embodiment, the shaft 64 is rotated in its forward direction when the conveyor motor 71 is rotated in the forward direction, but the shaft 64 is not rotated when the conveyor motor 71 is rotated in the reverse direction. Accordingly, when the conveyor motor 71 is rotated in the forward direction, the forward rotational power is transmitted to the conveyor rollers 60, 62, so that the conveyor rollers 60, 62 are rotated in their respective forward directions. On the other hand, when the conveyor motor 71 is rotated in the reverse direction, the reverse rotational power is transmitted to the first conveyor roller 60, but the third pulley 82 is idled on the shaft 64 by an action of the one-way clutch. Thus, the reverse rotational power is not transmitted to the second conveyor rollers 62. As a result, only the first conveyor roller 60 is rotated in its reverse direction, and the second conveyor rollers 62 are not rotated in its reverse direction.

The third power transmitter 50 includes a fourth pulley 84, a fifth pulley 85, and a third belt 86. The fourth pulley 84 is mounted on the shaft 64 on a left side of the third pulley 82. The fifth pulley 85 is mounted on a shaft 44 of the third conveyor rollers 45. The endless third belt 86 is looped over the fourth pulley 84 and the fifth pulley 85 so as to be tensioned therebetween. As a result, the rotational driving power transmitted to the second conveyor rollers 62 is transmitted to the third conveyor rollers 45.

<Controller 130>

Figure 5:
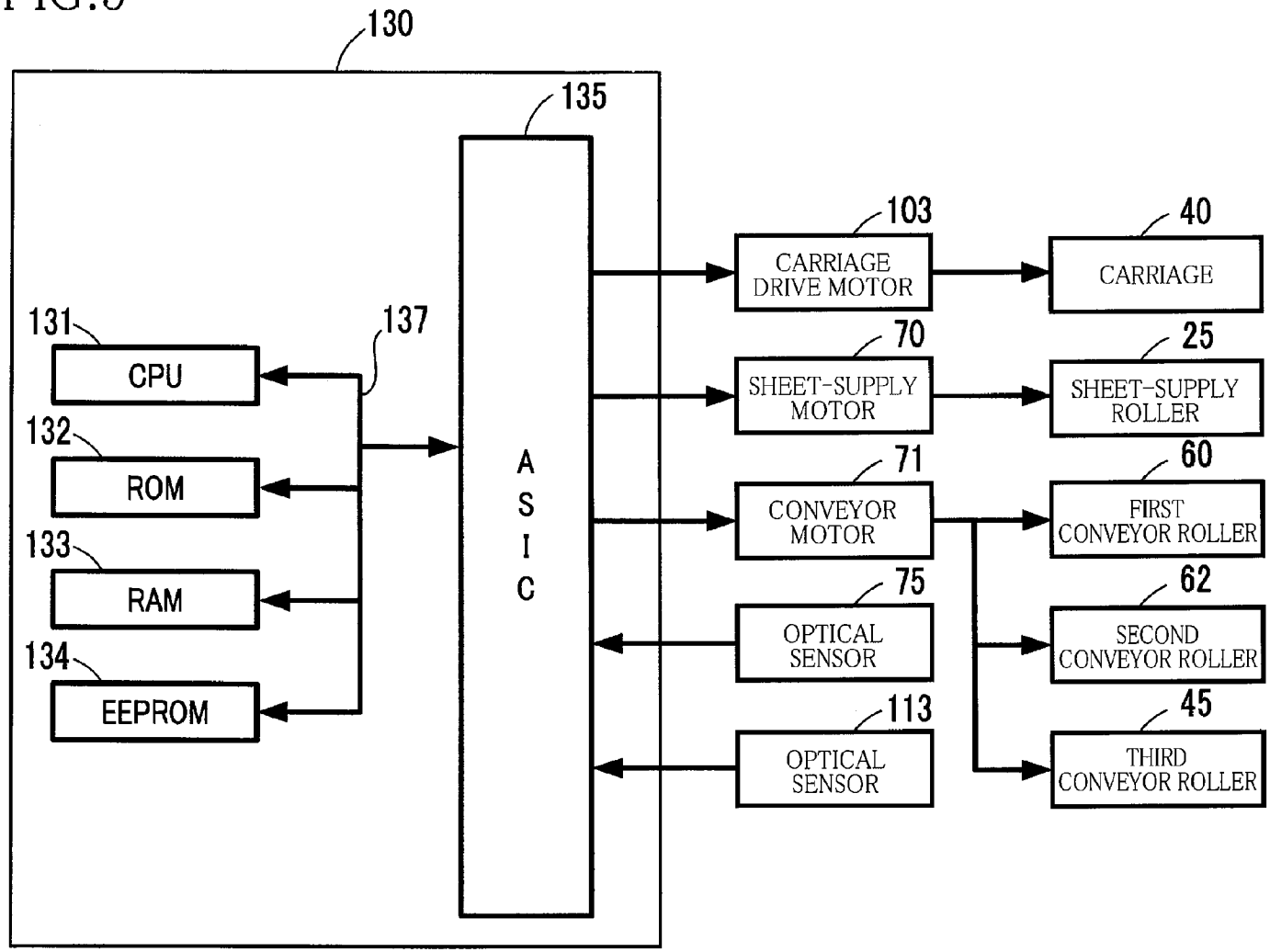
FIG. 5 is a block diagram illustrating a configuration of a controller 130.

The controller 130 controls overall operations of the MFP 10. For example, the controller 130 controls the sheet-feed motor 70 and the conveyor motor 71. As illustrated in FIG. 5, the controller 130 includes a CPU 131, a ROM 132, a RAM 133, an EEPROM 134, an ASIC 135, and an internal bus 137 for connecting these components to one another. The ROM 132 stores, e.g., programs for the CPU 131 to control various operations. The RAM 133 is used as a storage area for temporarily storing data and other information used when the CPU 131 executes the programs. The EEPROM 134 stores settings, flags, and other similar data which should be kept after the MFP 10 is turned off.

The motors 70, 71, 103 are coupled to the ASIC 135. When a drive signal for rotating each motor is transmitted from the CPU 131 to a corresponding drive circuit, a drive current related to the drive signal is output from the drive circuit to the motor, causing the motor to be rotated forwardly or reversely at a predetermined rotational speed. Also, a pulse signal output from the optical sensor 75 of the rotary encoder 73 is input to the ASIC 135. On the basis of this pulse signal transmitted from the optical sensor 75, the controller 130 calculates the rotational amount of the first conveyor roller 60. Also, the optical sensor 113 of the sensor 110 is connected to the ASIC 135. On the basis of a signal transmitted from the optical sensor 113, the controller 130 senses the leading edge and the trailing edge of the recording sheet 12 in the first direction 15 at the position of the sensor 110.

<Velocity Information>

Figure 6A:
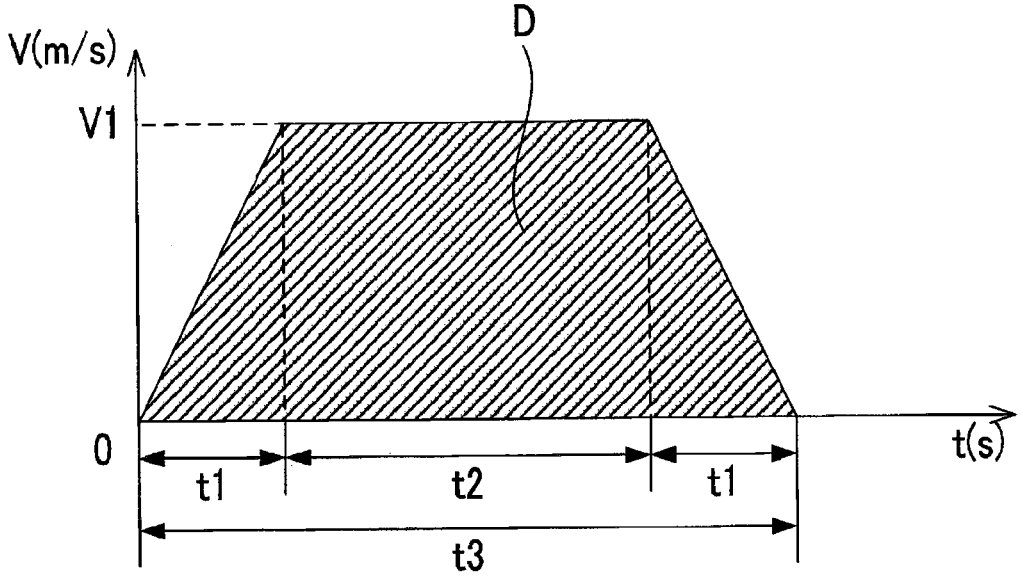
FIG. 6A is a characteristic diagram illustrating first information.
Figure 6B:
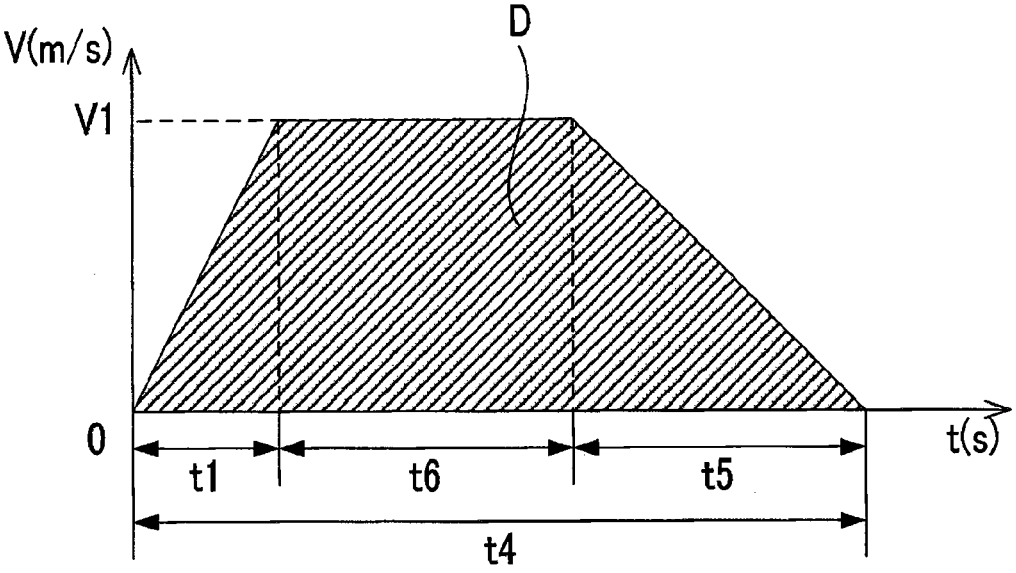
FIG. 6B is a characteristic diagram illustrating second information.

In the present embodiment, the ROM 132 stores a plurality of kinds of velocity information (i.e., speed information), specifically, first information and second information in the present embodiment. It is noted that the velocity information may be stored in the EEPROM 134. The ROM 132 or the EEPROM 134 storing the velocity information is one example of a storage. Here, the velocity information is predetermined target velocity information from a start of rotation of each of the conveyor rollers 60, 62, 45 to a stop of the rotation thereof to convey the recording sheet 12 by a predetermined linefeed distance (at S90 in FIG. 7 which will be described below) when each of the conveyor rollers 60, 62, 45 is rotated by the driving power transmitted from the conveyor motor 71 to convey the recording sheet 12. That is, as illustrated in FIGS. 6A and 6B, the velocity information is information regarding velocity (i.e., speed) V of each of the conveyor rollers 60, 62, 45 with respect to elapsed time t that is a length of time elapsed from a start of the driving of the conveyor motor 71. Specifically, the velocity information is a collection of data each representative of a relationship between elapsed time t and velocity V.

Each velocity information has the following characteristics. As illustrated in FIGS. 6A and 6B, each velocity information includes an acceleration period, a constant-velocity period, and a deceleration period. The first information will be explained first with reference to FIG. 6A. In the acceleration period, the conveyor motor 71 according to the first information rotates each of the conveyor rollers (namely, the first conveyor roller 60, the second conveyor rollers 62, and the third conveyor rollers 45) with a constant acceleration for time t1. Upon completion of the accelerated rotation for time t1, each conveyor roller is switched to be rotated at a constant velocity or velocity V1. The conveyor roller is rotated at the constant velocity for time t2 in the constant-velocity period. Upon completion of the constant-velocity rotation, the conveyor roller is rotated with a constant deceleration whose magnitude is equal to that of the acceleration in the acceleration period. After time t1 from a start of this speed reduction, the rotational velocity of the conveyor roller becomes zero. As a result, the conveyance of the recording sheet 12 is stopped. In the first information, a length of time from the start to the stop of the rotation of the conveyor roller is time t3 (=t1+t2+t1). Time t3 is one example of a first length of time. Also, hatched area D illustrated in FIG. 6A represents a rotational amount of the conveyor roller rotated according to the first information, and the recording sheet 12 is conveyed by a distance corresponding to the rotational amount.

There will be next explained the second information with reference to FIG. 6B. In the second information, a length of time from the start to the stop of the rotation of the conveyor roller is time t4 that is longer than time t3 in the first information. Time t4 is one example of a second length of time. In the second information in the present embodiment, a length of time required for reducing the velocity from velocity V1 to zero, i.e., a speed-reduction time, is set at time t5 that is longer than time t1. That is, a deceleration in the second information is lower than that in the first information. Here, a rotational amount of the conveyor roller rotated according to the second information is set to be equal to the rotational amount of the conveyor roller rotated according to the first information. Accordingly, in the second information in the present embodiment, since the speed-reduction time is longer than that in the first information, a length of time for rotating the conveyor roller at constant velocity, i.e., a constant-velocity time, is set at time t6 that is shorter than time t2 in the first information. In view of the above, a length of time from the start to the stop of the rotation of the conveyor roller in the second information is time t4 (=t1+t6+t5).

It is noted that the velocity in the constant-velocity period can be set to be higher than velocity V1 to shorten the length of time from the start to the stop of the rotation of the conveyor roller while keeping the deceleration at a relatively low rate.

<Control by Controller 130>

Figure 7:
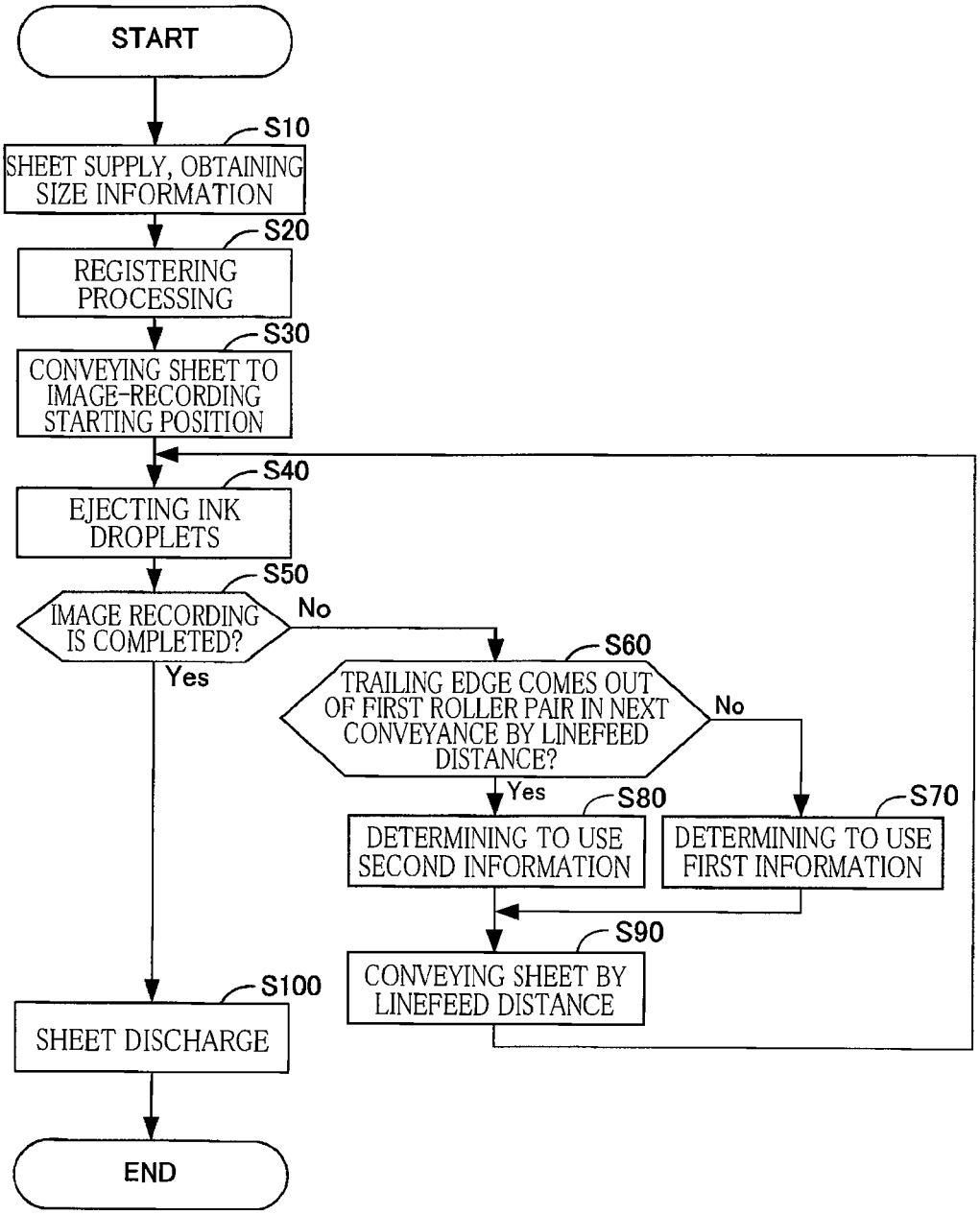
FIG. 7 is a flow chart for explaining a procedure of processings executed by the controller 130 to control rotations of the conveyor rollers 60, 62, 45.

There will be next explained, with reference to FIG. 7, a flow or a procedure of processings executed by the controller 130 to control the rotations of the conveyor rollers 60, 62. When a command for instructing image recording on the recording sheet 12 accommodated in the sheet-feed tray 20 is input to the MFP 10 from an external device such as a personal computer, the controller 130 drives the sheet-feed motor 70 to rotate the sheet-feed rollers 25. As a result, the recording sheet 12 is conveyed toward the first roller pair 58 (S10).

Also, at S10, size information of the recording sheet 12 for the image recording is input to the MFP 10 with the above-described command, and the controller 130 obtains the size information. Here, the size information is information containing a length of the recording sheet 12 in the first direction 15 when the sheet 12 is conveyed in the conveyance path 65. The processing at S10 at which the controller 130 obtains the size information is one example of a length obtaining processing.

At S20, the controller 130 executes a registering processing. Here, the registering processing is a processing in which the first conveyor roller 60 is stopped or rotated in the second rotational direction until a predetermined length of time has passed after the leading edge of the recording sheet 12 in the first direction 15 which has been conveyed by the sheet-feed rollers 25 at S10 reaches a nip position of the first roller pair 58. In the present embodiment, the controller 130 keeps the first conveyor roller 60 stopped until the predetermined length of time has passed. As a result, a downstream edge (i.e., the leading edge) of the recording sheet 12 in the first direction 15 is brought into contact with the first roller pair 58 at its nip position. As a result, a leading edge portion of the recording sheet 12 in the first direction 15 is bent or warped. Accordingly, even if the recording sheet 12 is in an oblique state while conveyed by the sheet-feed rollers 25, this oblique conveyance is corrected. The processing at S20 is one example of a leading-edge contact processing.

When the above-described predetermined length of time has passed, the controller 130 at S30 executes a processing for driving the conveyor motor 71 to rotate the first conveyor roller 60 in the first rotational direction. This processing is one example of a third rotation processing. As a result, the recording sheet 12 is nipped and conveyed by the first roller pair 58 in the first direction 15. When the recording sheet 12 reaches an image-recording starting position, the controller 130 stops the first conveyor roller 60 to stop the recording sheet 12. Here, assuming that an area on the recording sheet 12 where an image is to be recorded is an image recording area, the image-recording starting position is a position at which a downstream edge of the image recording area in the first direction 15 is opposed to the nozzles of the recording head 38.

Thereafter, the controller 130 repeats ejection of the ink droplets from the recording portion 24 (S40) and conveyance of the recording sheet 12 by the predetermined linefeed distance (S90, as one example of conveyance of the sheet) until an image is recorded on the entire image recording area, that is, until the image recording on the recording sheet 12 is completed (S50). Here, the predetermined linefeed distance is appropriately determined on the basis of the number of nozzles of the recording head 38 and a resolution of an image to be recorded on the recording sheet 12, for example. That is, the controller 130 executes intermittent conveyance in which the conveyance of the recording sheet 12 by the predetermined linefeed distance and the stop of the recording sheet 12 are alternately repeated.

When the controller 130 at S50 determines that the image recording is completed (S50: Yes), the recording sheet 12 is conveyed in the first direction 15. As a result, the recording sheet 12 is discharged onto the sheet-output tray 21 at S100. On the other hand, when the controller 130 at S50 determines that the image recording is not completed (S50: No), this flow goes to S60.

The controller 130 at S60 determines whether an upstream edge, i.e., the trailing edge of the recording sheet 12 in the first direction 15 passes through the first roller pair 58 or not in a next conveyance of the recording sheet 12 by the predetermined linefeed distance (S90). In other words, the controller 130 at S60 determines whether the trailing edge of the recording sheet 12 in the first direction 15 comes out of the first roller pair 58 or not. That is, the controller 130 at S60 determines whether or not a state of the recording sheet 12 is to transition at S90 from a state in which the recording sheet 12 is nipped by the first roller pair 58 and the second roller pair 59 (and the third roller pair 47) to a state in which the recording sheet 12 is nipped by only the second roller pair 59 (and the third roller pair 47). In other words, the controller 130 determines whether a state in which the recording sheet 12 is nipped by only the second roller pair 59 without nipped by both of the first roller pair 58 and the second roller pair 59 is established or not.

In the present embodiment, the determination at S60 is made on the basis of: the rotational amount of the first conveyor roller 60 calculated on the basis of the pulse signal output by the optical sensor 75; and the length of the recording sheet 12 in the first direction 15 which is obtained at S10. Specifically, the controller 130 compares an estimated conveyance amount L1 of the recording sheet 12 from the start of the rotation of the first conveyor roller 60 at S30 to the end of the next conveyance of the recording sheet 12 by the predetermined linefeed distance at S90, with the length L2 of the recording sheet 12 in the first direction 15. When a distance corresponding to the estimated conveyance amount L1 is longer than the length L2, the controller 130 determines that the above-described state transition is to be made. On the other hand, when the distance corresponding to the estimated conveyance amount L1 is equal to or shorter than the length L2, the above-described state transition is not to be made.

It is noted that while the controller 130 compares the distance corresponding to the estimated conveyance amount L1 with the length L2 in the present embodiment, the controller 130 may compare the distance corresponding to the estimated conveyance amount L1 with a value L3 that is obtained by adding, e.g., various accuracy errors to the length L2. Here, examples of the various accuracy errors include: an error due to variations in the size of the recording sheet 12 to be conveyed; and a positional error of the recording sheet 12 in the above-described registering processing.

When the controller 130 at S60 determines that the above-described state transition is not to be made (S60: No), the controller 130 at S70 determines to rotate the conveyor rollers 60, 62, 45 according to the first information and then at S90 rotates the conveyor rollers 60, 62, 45 according to the first information in the conveyance of the recording sheet 12 by the predetermined linefeed distance. In this case, the processings at S70 and S90 are one example of a first rotation processing. On the other hand, when the controller 130 at S60 determines that the above-described state transition is to be made (S60: Yes), the controller 130 at S80 determines to rotate the conveyor rollers 60, 62, 45 according to the second information and then at S90 rotates the conveyor rollers 60, 62, 45 according to the second information in the conveyance of the recording sheet 12 by the predetermined linefeed distance. In this case, the processings S80 and S90 are one example of a second rotation processing.

<Effects>

In the present embodiment, even when the driving power is not transmitted to the second conveyor rollers 62 due to idling of the one-way clutch, the second conveyor rollers 62 may possibly slip and rotate due to inertia. In the present embodiment, however, it is possible to reduce the rotation as will be explained below.

Since each of the first information and the second information is velocity information regarding conveyance of the recording sheet 12 by the predetermined linefeed distance, the first information and the second information concern the same conveyance amount D. The second information is information in which the length of time from the start of the rotation and the stop of the rotation is set to be longer than that in the first information. Thus, the rotational velocity or at least one of the rotational acceleration and deceleration in the second information (the rotational deceleration in the present embodiment) is set to be lower than that in the first information.

Accordingly, in the present embodiment, when the recording sheet 12 is not nipped by the first roller pair 58, the controller 130 according to the second information controls the second conveyor rollers 62 to rotate at a velocity lower than a velocity corresponding to the first information or reduces the velocity of the second conveyor rollers 62 with a deceleration lower than a deceleration corresponding to the first information. That is, the controller 130 does not cause a sudden speed reduction of the second conveyor rollers 62. This makes it possible to reduce the possibility that the second conveyor rollers 62 slip and rotate due to inertia in the speed reduction. Thus, even in the case where the recording sheet 12 is nipped by the second roller pair 59 without being nipped by the first roller pair 58, it is possible to reduce the positional error of the recording sheet 12 due to the rotation of the second conveyor rollers 62. As a result, it is possible to reduce a possibility of the positional error of the recording sheet 12 in the conveyance path 65.

Also, in the present embodiment, in the case where the recording sheet 12 is nipped by the first roller pair 58, that is, in a case where a back tension is applied to the recording sheet 12 by the first roller pair 58, the controller 130 performs the sudden speed reduction for the second conveyor rollers 62 as in a case where the forward rotational power and the reverse rotational power produced by the conveyor motor 71 are transmitted to the second roller pair 59. As a result, the controller 130 can speedily execute the intermittent conveyance.

Also, in the present embodiment, when the leading edge of the recording sheet 12 in the first direction 15 is held in contact with the first roller pair 58, the position of the leading edge in the conveyance path 65 can be accurately recognized. Also, since the controller 130 obtains the size information such as A4 and B5, the length of the recording sheet 12 in the first direction 15 can be accurately recognized. Therefore, in the present embodiment, the controller 130 can accurately determine whether or not the state in which the recording sheet 12 is nipped by the first roller pair 58 is kept during the next conveyance of the recording sheet 12 by the linefeed distance.

Also, since the second information is designed as in FIG. 6B in the present embodiment, it is possible to reduce the deceleration of the second conveyor rollers 62 rotated according to the second information. As a result, it is possible to reduce the possibility that the second conveyor rollers 62 rotate due to inertia in the speed reduction.

<First Modification>

The controller 130 determines at S60 whether the above-described state transition is to be made or not by comparing the distance corresponding to the estimated conveyance amount L1 with the length L2 in the above-described embodiment. Nevertheless, the method of this determination is not limited to this comparison. For example, the controller 130 may compare an estimated conveyance amount L4 of the recording sheet 12 from passage of the trailing edge of the recording sheet 12 in the first direction 15 through the sensor 110, i.e., sense of the trailing edge by the sensor 110, to the end of the next conveyance of the recording sheet 12 by the predetermined linefeed distance, with a length (distance) L5 (see FIG. 2) extending along the conveyance path 65 from the sensor 110 to the nip position of the first roller pair 58. In this configuration, for example, when a distance corresponding to the estimated conveyance amount L4 is longer than the length L5, the controller 130 determines that the above-described state transition is to be made. On the other hand, when the distance corresponding to the estimated conveyance amount L4 is equal to or shorter than the length L5, the controller 130 determines that the above-described state transition is not to be made.

In a case where the sensor 110 is constituted by, e.g., the optical sensor 113 with an extremely quick response as in this first modification, the sensor 110 can accurately sense the trailing edge of the recording sheet 12. Also, the length L5 between the sensor 110 and the first roller pair 58 along the conveyance path 65 can be accurately determined as a design value. Therefore, in the first modification, the controller 130 can accurately determine whether or not the state in which the recording sheet 12 is nipped by the first roller pair 58 is kept in the next conveyance of the recording sheet 12 by the linefeed distance.

<Second Modification>

Figure 8A:
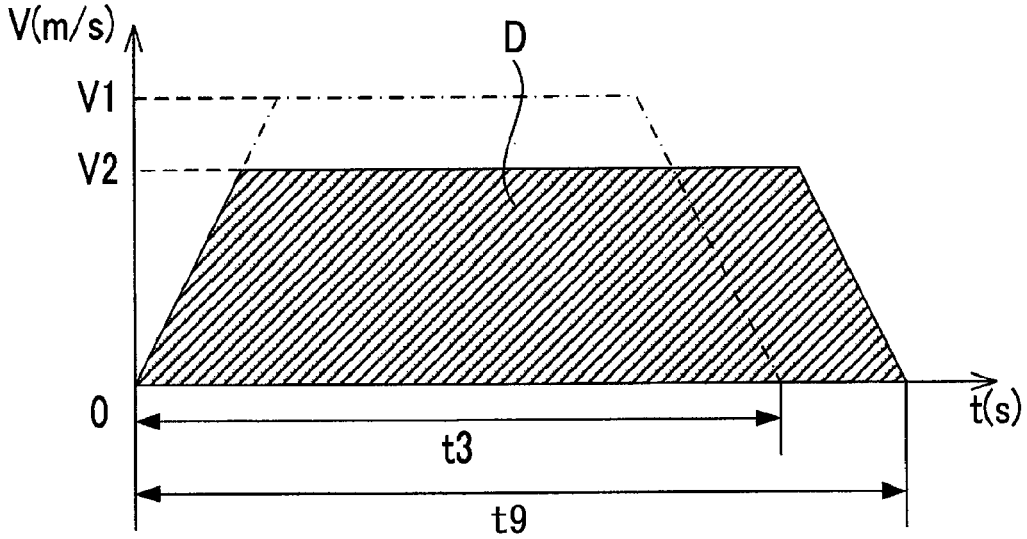
FIG. 8A is a characteristic diagram illustrating second information in a second modification.

In the second information in the above-described embodiment, as illustrated in FIG. 6B, the length of time required for reducing the velocity from velocity V1 to zero is set at time t5 that is longer than time t1, whereby the length of time from the start to the stop of the rotation of the conveyor roller is set at time t4 that is longer than time t3. However, the second information may set such that the length of time from the start to the stop of the rotation of the conveyor roller is longer than time t3, by a setting that differs from the setting of the increased speed-reduction time. For example, as illustrated in FIG. 8A, the second information may be set such that the length of time from the start to the stop of the rotation of the conveyor roller is set at time t9 that is longer than time t3, by setting the velocity in the constant-velocity period at velocity V2 that is lower than velocity V1 in the first information. It is to be understood that the hatched areas D in the first information and the second information need to be equal to each other also in this modification. Also, since the second information is designed as in FIG. 8A in the present modification, it is possible to reduce a length of time required for the sudden speed reduction of the second conveyor rollers 62 rotated according to the second information. As a result, it is possible to reduce a possibility that the second conveyor rollers 62 rotate due to inertia in the sudden speed reduction.

<Third Modification>

Upon the processings at S60-S80 for determining the velocity information in FIG. 7, the controller 130 may refer to a rotational amount of each of the first conveyor roller 60 and the second conveyor rollers 62 in the processing(s) at S90 executed previously. A detailed explanation will be provided below.

Figure 11:
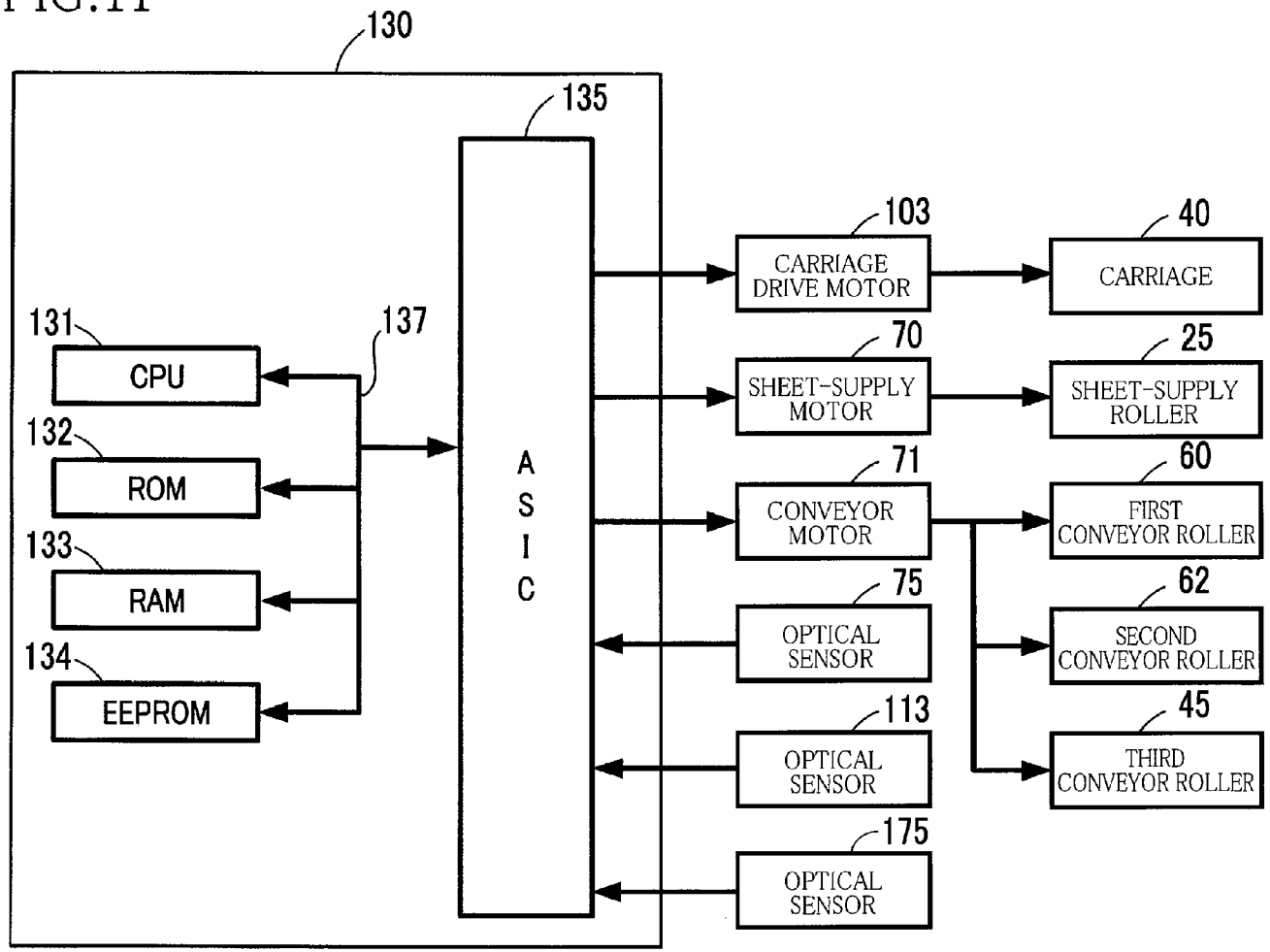
FIG. 11 is a block diagram illustrating a configuration of the controller 130 in the third modification.

In this third modification, a rotary encoder, not shown, is provided for the second conveyor rollers 62. This rotary encoder has a construction similar to that of the rotary encoder 73 provided for the first conveyor roller 60. The rotary encoder provided for the second conveyor rollers 62 is constituted by an optical sensor 175 (see FIG. 11) and an encoder disc configured to rotate with the second conveyor rollers 62. As in the case of the rotary encoder 73, the controller 130 calculates the rotational amount of each second conveyor roller 62 on the basis of an output of the optical sensor 175. The rotary encoder provided for the second conveyor rollers 62 and the controller 130 are one example of a second-drive-roller rotational amount detector.

Figure 8B:
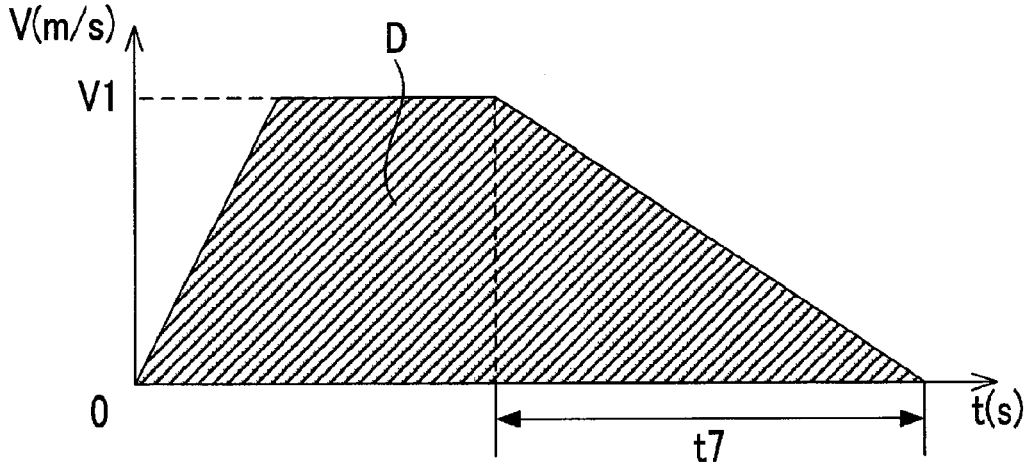
FIG. 8B is a characteristic diagram illustrating third information in a third modification.

Also, in this third modification, the ROM 132 (or the EEPROM 134) stores third information in addition to the first information and the second information. Here, the third information is information in which the length of time from the start to the stop of the rotation of the conveyor roller is set to be longer than that in the second information. For example, as illustrated in FIG. 8B, in the third information, the speed-reduction time for reducing the velocity from velocity V1 to zero is set at time t7 that is longer than time t5 used in the second information in FIG. 6B. Time t7 is one example of a third length of time.

Figure 9:
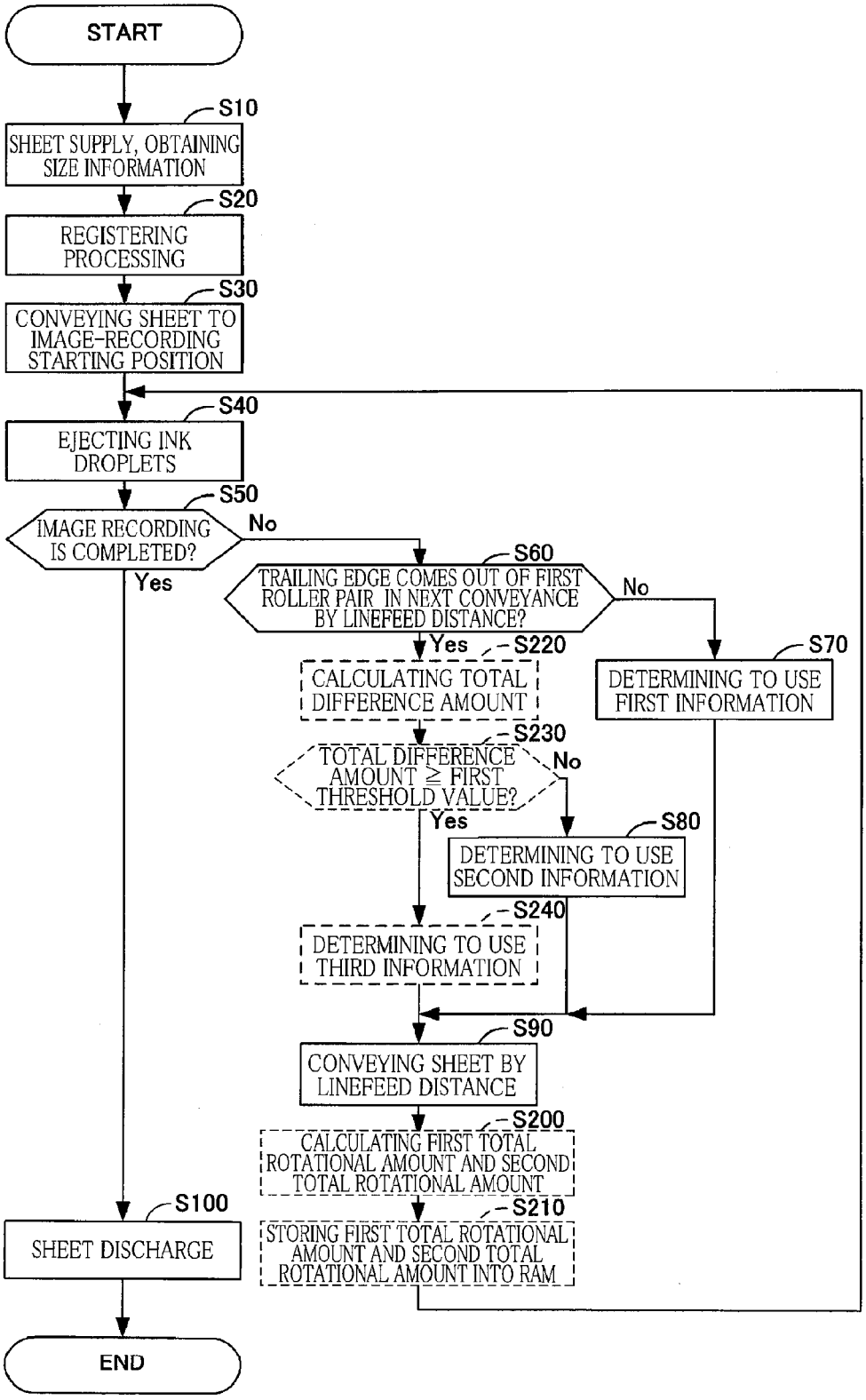
FIG. 9 is a flow chart for explaining a procedure of processings executed by the controller 130 to control rotations of the conveyor rollers 60, 62, 45 in the third modification.

There will be explained, with reference to FIG. 9, a flow or a procedure of processings executed by the controller 130 to control the rotations of the conveyor rollers 60, 62 in the third modification. In the following explanation, an explanation of the same processings as executed in the flow in FIG. 7 is omitted. That is, there will be explained processings at S200-S240 indicated by broken lines in FIG. 9.

At S200 after S90, the controller 130 calculates the rotational amount of the first conveyor roller 60 and the rotational amount of the second conveyor rollers 62 in the deceleration period of the conveyance of the recording sheet 12 by the predetermined linefeed distance (S90). Here, in the cases in FIGS. 6A and 6B, for example, the deceleration period is a period of the speed reduction from the velocity V1 to the stop of the rotation over time t1 in FIG. 6A or time t5 in FIG. 6B. Then at S200, the controller 130 cumulatively adds the rotational amount of each of the conveyor rollers 60, 62 calculated at S200 to the rotational amount of a corresponding one of the conveyor rollers 60, 62 which has been calculated at S200 previously. In other words, the controller 130 obtains a cumulative total of the rotational amounts of the first conveyor roller 60 in the deceleration period as a first total rotational amount and calculates a cumulative total of the rotational amounts of each second conveyor roller 62 in the deceleration period as a second total rotational amount. This cumulative addition is performed a predefined number of times which is stored in the ROM 132 or the EEPROM 134. At S210, the first total rotational amount of the first conveyor roller 60 and the second total rotational amount of the second conveyor rollers 62 are stored into the RAM 133. The processing at S210 is one example of a first-total-rotational-amount calculating processing and a second-total-rotational-amount calculating processing.

At S220 after S60, the controller 130 calculates a total difference amount that is an amount of difference (i.e., a difference amount) between the first total rotational amount and the second total rotational amount stored at S210. The processing at S220 is one example of a total-difference-amount calculating processing. Then at S230, the controller 130 determines whether or not the total difference amount calculated at S220 is equal to or greater than a predefined first threshold value stored in the ROM 132 or the EEPROM 134. When the total difference amount is equal to or greater than the first threshold value (S230: Yes), the controller 130 at S240 determines to rotate the conveyor rollers 60, 62, 45 according to the third information and then at S90 rotates the conveyor rollers 60, 62, 45 according to the third information. In this case, the processings at S240 and S90 are one example of the second rotation processing. On the other hand, when the total difference amount is less than the first threshold value (S230: No), this flow goes to S80.

Even in the case where the conveyor rollers 60, 62 are rotated according to the second information, the second conveyor rollers 62 may rotate due to inertia in each deceleration period. However, in a case where the amount of the rotation due to inertia in one deceleration period is small, there is a possibility that the rotational amount is discarded or ignored in the processings executed by the controller 130. To solve this problem, in the third modification, the controller 130 cumulatively adds the rotational amounts in the predefined number of deceleration periods and compares the total difference amount with the first threshold value. Thus, even in the case where the amount of the rotation due to inertia in one deceleration period is small, it is possible to find the rotation of the second conveyor rollers 62 due to inertia. In this third modification, in a case where the controller 130 has found the rotation of the second conveyor rollers 62 due to inertia, the controller 130 rotates the second conveyor rollers 62 according to the third information in the next conveyance of the recording sheet 12 by the linefeed distance. This makes it possible to reduce the possibility that the second conveyor rollers 62 slip and rotate due to inertia in the speed reduction.

<Fourth Modification>

Figure 10:
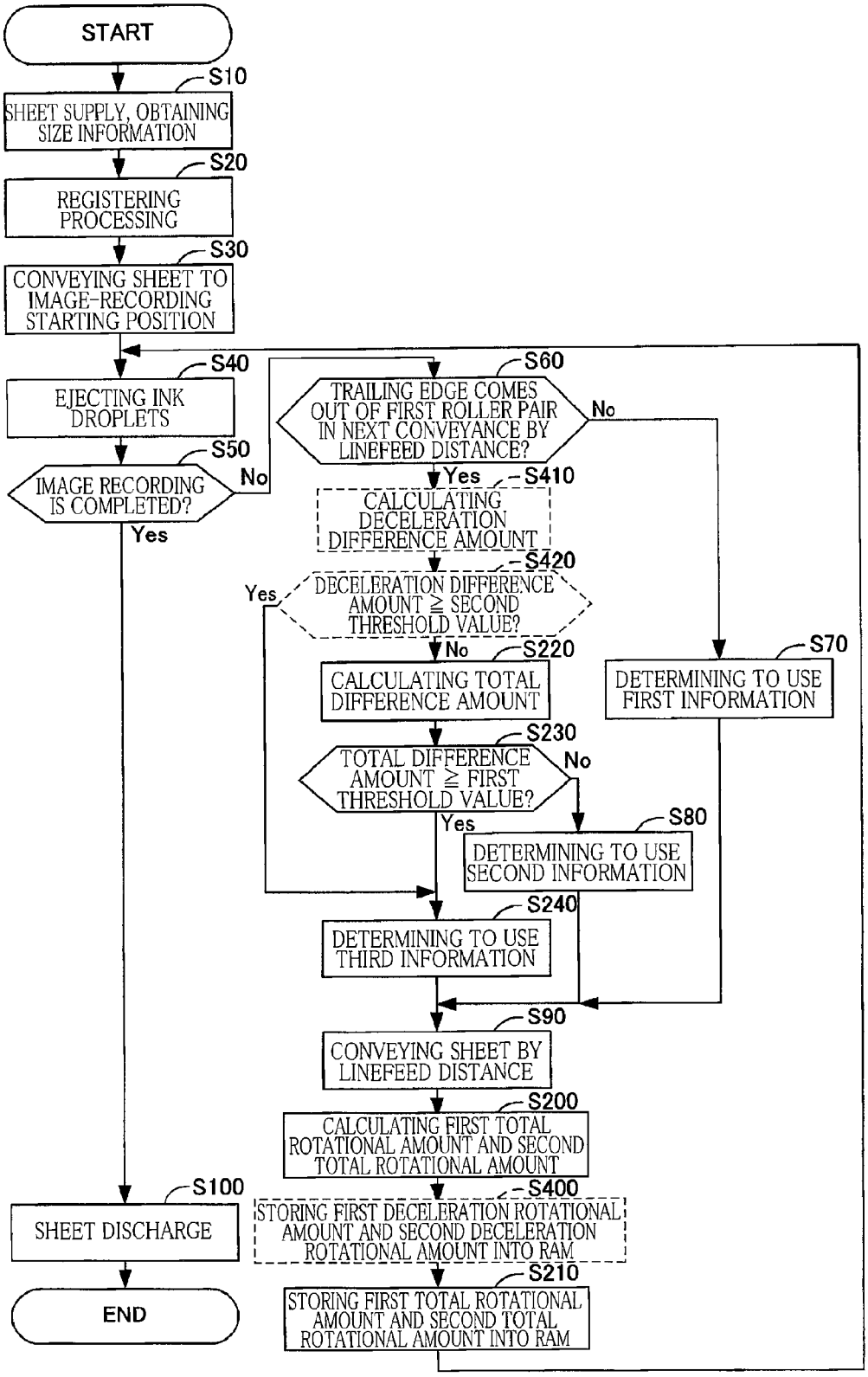
FIG. 10 is a flow chart for explaining a procedure of processings executed by the controller 130 to control rotations of the conveyor rollers 60, 62, 45 in a fourth modification.

In the third modification, the controller 130 calculates the total rotational amounts of the predefined number of executions of the deceleration periods. In addition to this configuration, the controller 130 may calculate a difference (an amount of difference) of the rotational amounts in each deceleration period to determine velocity information to be used, on the basis of the difference. There will be explained, with reference to FIG. 10, a flow or a procedure of processings in this fourth modification. In the following explanation, an explanation of the same processings as executed in the flow in the third modification (FIG. 9) is omitted. That is, there will be explained processings at S400-S420 indicated by broken lines in FIG. 10.

In this fourth modification, the controller 130 at S400 stores, into the RAM 133, a first deceleration rotational amount that is the rotational amount calculated at S200 for the first conveyor roller 60 in the deceleration period and a second deceleration rotational amount that is the rotational amount calculated at S200 for each second conveyor roller 62 in the deceleration period. The processing at S200 is one example of a first-deceleration-rotational-amount calculating processing and a second-deceleration-rotational-amount calculating processing. Also, in this fourth modification, the controller 130 executes processings at S410 and S420 between the processings at S60 and S220. At S410, the controller 130 calculates a deceleration difference amount that is a difference between the first deceleration rotational amount and the second deceleration rotational amount that are stored in the RAM 133 at S400. The processing at S410 is one example of a deceleration-difference-amount calculating processing.

Then at S420, the controller 130 determines whether or not the deceleration difference amount calculated at S410 is equal to or greater than a predefined second threshold value stored in the ROM 132 or the EEPROM 134. When the deceleration difference amount is equal to or greater than the second threshold value (S420: Yes), the controller 130 at S240 determines to rotate the conveyor rollers 60, 62, 45 according to the third information and then at S90 rotates the conveyor rollers 60, 62, 45 according to the third information. Also in this case, the processings at S240 and S90 are one example of the second rotation processing. On the other hand, when the deceleration difference amount is less than the second threshold value (S420: No), this flow goes to S220.

In the third modification, even in a case where the amount of rotation due to inertia is relatively large in one deceleration period, the controller 130 does not rotate the second conveyor rollers 62 according to the third information unless the predefined number of deceleration periods have been passed. To solve this problem, in the fourth modification, the controller 130 calculates the rotational amount in each deceleration period and compares it with the threshold value in addition to calculating the cumulative total of the rotational amounts in the predefined number of deceleration periods and compares the total with the threshold value. As a result, in the case where the amount of rotation due to inertia is relatively large in one deceleration period, the controller 130 can rotate the second conveyor rollers 62 according to the third information in a next conveyance of the recording sheet 12 by the linefeed distance.

<Fifth Modification>

The second information may be information that simply satisfies a condition in which the deceleration in the deceleration period (i.e., the deceleration from the end of the constant-velocity state to the stop of the rotation) is lower than that in the first information.

Figure 8C:
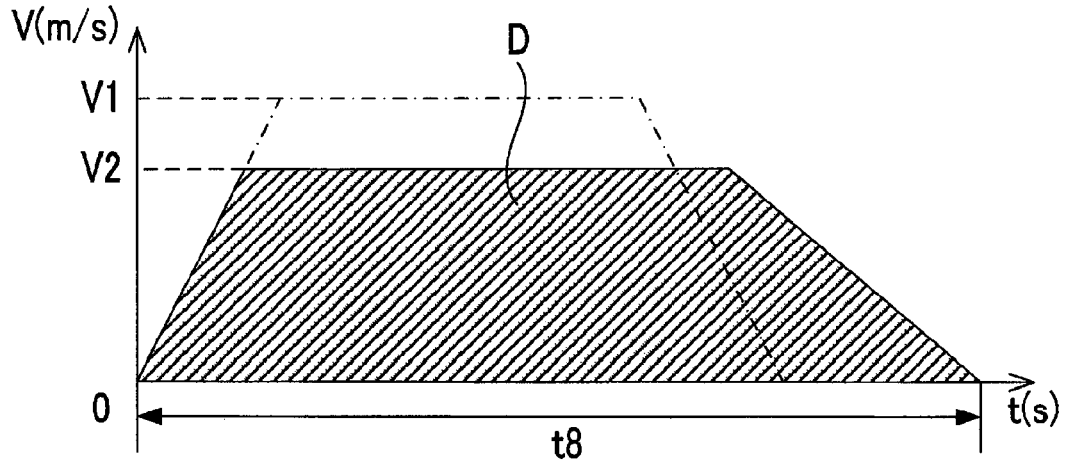
FIG. 8C is a characteristic diagram illustrating second information in a fifth modification.

For example, as illustrated in FIG. 8C, the second information may be set such that the velocity in the constant-velocity period is set at velocity V2 that is lower than velocity V1 in the first information and such that the length of time from the start to the stop of the rotation of the conveyor roller is set at time t8 that is longer than time t3. It is to be understood that the hatched areas D in the first information and the second information need to be equal to each other also in this modification. Also, since the second information is designed as in FIG. 8C in the present modification, it is possible to prevent the sudden speed reduction of the second conveyor rollers 62 rotated according to the second information. As a result, it is possible to reduce the possibility that the second conveyor rollers 62 rotate due to inertia in the sudden speed reduction.

It is noted that in a case where the fifth modification and the third modification are combined with each other, the third information is information in which the deceleration in the deceleration period is lower than that in the second information.

According to this explanation and the above-described embodiment, the third information is information in which a different point (i.e., a point of difference) between the first information and the third information is the same as a different point between the first information and the second information, and a difference amount of the different point between the first information and the third information is greater than a difference amount of the different point between the first information and the second information. For example, a different point between the third information illustrated in FIG. 8B and the first information illustrated in FIG. 6A is the length of time from the start of the rotation to the stop of the rotation. This different point is the same as that between the first information and the second information illustrated in FIG. 6B. A difference amount between the length of time from the start of the rotation to the stop of the rotation in the third information and that in the first information is greater than a difference between time t4 and time t3 (t4−t3) that is a difference amount between the length of time from the start of the rotation to the stop of the rotation in the second information and that in the first information.

What is claimed is:

1. A conveyor device, comprising:

a drive source configured to produce: a first rotational driving power by a forward rotation of the drive source; and a second rotational driving power by a reverse rotation of the drive source;

a first conveyor comprising a first drive roller and a first driven roller;

a second conveyor disposed downstream of the first conveyor in a conveying direction, the second conveyor comprising a second drive roller and a second driven roller;

a first power transmitter configured to transmit the first rotational driving power and the second rotational driving power to the first drive roller, the first power transmitter being configured to have the first conveyor convey a sheet in the conveying direction while nipping the sheet when the first rotational power is transmitted to the first drive roller, the first power transmitter being configured to have the first conveyor convey the sheet in a direction opposite the conveying direction when the second rotational power is transmitted to the first drive roller;

a second power transmitter configured to transmit the first rotational driving power to the second drive roller and not to transmit the second rotational driving power to the second drive roller, the second power transmitter being configured to have the second conveyor convey the sheet in the conveying direction while nipping the sheet when the first rotational power is transmitted to the second drive roller;

a controller configured to control the drive source to perform intermittent conveyance in which a conveyance of the sheet by transmission of the first rotational driving power to the first drive roller and the second drive roller and a stop of the sheet conveyed are alternately repeated a plurality of times; and a storage configured to store first information and second information each representing velocity information of the first drive roller and the second drive roller from a start of rotation thereof to a stop of the rotation thereof in one conveyance of the sheet in the intermittent conveyance, and wherein at least one of a velocity and a deceleration, in the velocity information, of the first drive roller and the second drive roller from a constant-velocity state after an increase in velocity from the start of the rotation, to the stop of the rotation is less in the second information than in the first information, wherein the controller is configured to execute:

a first rotation processing in which, when a state in which the sheet is nipped by the first conveyor is kept during a next conveyance of the sheet in the intermittent conveyance, the first drive roller and the second drive roller are rotated according to the first information in the next conveyance of the sheet; and a second rotation processing in which, when the state in which the sheet is nipped by the first conveyor is not kept in the next conveyance of the sheet, the first drive roller and the second drive roller are rotated according to the second information in the next conveyance of the sheet.

2. The conveyor device according to claim 1, wherein the controller is configured to control the drive source to perform the intermittent conveyance in which a plurality of conveyances of one sheet and a plurality of stops of the one sheet are performed in the intermittent conveyance such that one conveyance of the one sheet and one stop of the one sheet are alternately performed, wherein the controller is configured to execute the first rotation processing as the one conveyance of the sheet in the intermittent conveyance, and wherein the controller is configured to execute the second rotation processing as the one conveyance of the sheet in the intermittent conveyance.

3. The conveyor device according to claim 1, further comprising:

a sheet feeder disposed upstream of the first conveyor in the conveying direction and configured to feed the sheet toward the first conveyor;

a first-drive-roller rotational amount detector configured to detect a rotational amount of the first drive roller, wherein the controller further executes:

a leading-edge contact processing at which the controller controls the sheet feeder to feed the sheet toward the first conveyor to bring a leading edge of the sheet in the conveying direction into contact with the first conveyor that is stopped or is receiving the second rotational driving power;

a third rotation processing at which the first rotational driving power is transmitted to the first drive roller on condition that the leading edge of the sheet in the conveying direction has been brought into contact with the first conveyor in the leading-edge contact processing, and wherein the controller is configured to execute one of the first rotation processing and the second rotation processing based on the rotational amount from the third processing executed.

4. The conveyor device according to claim 3, wherein the controller is configured to execute a length obtaining processing in which the controller obtains a length of the sheet to be conveyed, wherein the length of the sheet is a length in the conveying direction, and wherein the controller is configured to execute one of the first rotation processing and the second rotation processing based on the rotational amount and the length of the sheet which has been obtained in the length obtaining processing.

5. The conveyor device according to claim 4, wherein the controller is configured to execute the first rotation processing until the rotational amount becomes greater than an amount corresponding to the length of the sheet in the conveying direction, and wherein the controller is configured to execute the second rotation processing when the rotational amount becomes greater than the amount corresponding to the length of the sheet in the conveying direction.

6. The conveyor device according to claim 1, further comprising:

a sheet sensor configured to sense the sheet passing through a specific position located upstream of the first conveyor in the conveying direction;

a first-drive-roller rotational amount detector configured to detect a rotational amount of the first drive roller, wherein the controller is configured to execute one of the first rotation processing and the second rotation processing based on a rotational amount of the first drive roller from a sense of a trailing edge of the sheet in the conveying direction by the sheet sensor.

7. The conveyor device according to claim 6, wherein the controller is configured to execute one of the first rotation processing and the second rotation processing based on the rotational amount and a distance between the specific position and the first conveyor.

8. The conveyor device according to claim 7, wherein the controller is configured to execute the first rotation processing until the rotational amount becomes greater than an amount corresponding to the distance between the specific position and the first conveyor, and wherein the controller is configured to execute the second rotation processing when the rotational amount becomes greater than the amount corresponding to the distance between the specific position and the first conveyor.

9. The conveyor device according to claim 1, wherein a velocity, in the velocity information, of the first drive roller and the second drive roller in the constant-velocity state after the increase in velocity from the start of the rotation is less in the second information than in the first information.

10. The conveyor device according to claim 1, further comprising a second-drive-roller rotational amount detector configured to detect a rotational amount of the second drive roller, wherein the storage is configured to further store third information, wherein a different point between the first information and the third information is identical to a different point between the first information and the second information, and a difference amount of the different point between the first information and the third information is greater than a difference amount of the different point between the first information and the second information, wherein the controller is configured to execute:

a first-total-rotational-amount calculating processing in which the controller calculates a first total rotational amount that is a cumulative total of a plurality of rotational amounts of the first drive roller respectively in a predefined number of deceleration periods each of which is a deceleration period in a conveyance of the sheet by the one conveyance in the intermittent conveyance;

a second-total-rotational-amount calculating processing in which the controller calculates a second total rotational amount that is a cumulative total of a plurality of rotational amounts of the second drive roller respectively in the predefined number of deceleration periods; and a total-difference-amount calculating processing in which the controller calculates a total difference amount that is a total of the first total rotational amount and the second total rotational amount, and wherein the controller is configured to, when the total difference amount in the second rotation processing is equal to or greater than a predefined threshold value, rotate the first drive roller and the second drive roller according to the third information in the next conveyance of the sheet.

11. The conveyor device according to claim 1, further comprising a second-drive-roller rotational amount detector configured to detect a rotational amount of the second drive roller, wherein the storage is configured to further store third information, wherein a different point between the first information and the third information is identical to a different point between the first information and the second information, and a difference amount of the different point between the first information and the third information is greater than a difference amount of the different point between the first information and the second information, wherein the controller is configured to execute:

a first-deceleration-rotational-amount calculating processing in which the controller calculates a first deceleration rotational amount of the first drive roller in each of the deceleration periods;

a second-deceleration-rotational-amount calculating processing in which the controller calculates a second deceleration rotational amount of the second drive roller in each of the deceleration periods; and a deceleration-difference-amount calculating processing in which the controller calculates a deceleration difference amount that is a difference between the first deceleration rotational amount and the second deceleration rotational amount, wherein the controller is configured to, when the deceleration difference amount in the second rotation processing is equal to or greater than a predefined threshold value, rotate the first drive roller and the second drive roller according to the third information in the next conveyance of the sheet.

12. The conveyor device according to claim 11, wherein a deceleration of the first drive roller and the second drive roller from an end of a constant-velocity state after the increase in velocity from the start of the rotation, to the stop of the rotation is less in the second information than in the first information.

13. A conveyor device, comprising:

a drive source configured to produce: a first rotational driving power by a forward rotation of the drive source; and a second rotational driving power by a reverse rotation of the drive source;

a first conveyor comprising a first drive roller and a first driven roller;

a second conveyor disposed downstream of the first conveyor in a conveying direction, the second conveyor comprising a second drive roller and a second driven roller;

a first power transmitter configured to transmit the first rotational driving power and the second rotational driving power to the first drive roller, the first power transmitter being configured to have the first conveyor convey the sheet in the conveying direction while nipping the sheet when the first rotational power is transmitted to the first drive roller, the first power transmitter being configured to have the first conveyor convey the sheet in a direction opposite the conveying direction when the second rotational power is transmitted to the first drive roller;

a second power transmitter configured to transmit the first rotational driving power to the second drive roller and not to transmit the second rotational driving power to the second drive roller, the second power transmitter being configured to have the second conveyor convey the sheet in the conveying direction while nipping the sheet when the first rotational power is transmitted to the second drive roller;

a controller configured to control the drive source to perform intermittent conveyance in which a conveyance of the sheet by transmission of the first rotational driving power to the first drive roller and the second drive roller and a stop of the sheet conveyed are alternately repeated a plurality of times; and a storage configured to store first information and second information respectively representing a first length of time and a second length of time, wherein each of the first length of time and the second length of time is a length of time from a start of rotation of the first drive roller and the second drive roller to a stop of the rotation thereof in conveyance of the sheet, and wherein the second length of time is greater in length than the first length of time, wherein the controller is configured to execute:

a first rotation processing in which, when a state in which the sheet is nipped by the first conveyor is kept during a next conveyance of the sheet in the intermittent conveyance, the first drive roller and the second drive roller are rotated according to the first information in the next conveyance of the sheet; and a second rotation processing in which, when the state in which the sheet is nipped by the first conveyor is not kept in the next conveyance of the sheet, the first drive roller and the second drive roller are rotated according to the second information in the next conveyance of the sheet.

* * * * *